United States Patent [19]

Kuwako et al.

[11] 4,402,194

[45] Sep. 6, 1983

[54] ICE MAKING APPARATUS TO BE INCORPORATED IN REFRIGERATORS

[75] Inventors: Tomohisa Kuwako, Anjo; Yoshitaka Fujiwara, Nagoya, both of Japan

[73] Assignee: Kabushiki Kaisha Tokai Rika Denki Seisakusho, Nishi Kasugai, Japan

[21] Appl. No.: 333,614

[22] Filed: Dec. 22, 1981

Related U.S. Application Data

[63] Continuation-in-part of Ser. No. 172,281, Jul. 25, 1980, abandoned.

[30] Foreign Application Priority Data

Jul. 30, 1979 [JP] Japan ..... 54-104088[U]

[51] Int. Cl.[3] ..... F25C 5/06

[52] U.S. Cl. ..... 62/353; 318/282

[58] Field of Search ..... 62/72, 137, 353; 310/41; 318/282

[56] References Cited

U.S. PATENT DOCUMENTS

| | | | |
|---|---|---|---|
| 3,026,684 | 3/1962 | Chace | 62/353 X |
| 3,071,933 | 1/1963 | Shoemaker | 62/353 X |
| 3,182,465 | 5/1965 | De Miller et al. | 62/353 X |
| 3,217,510 | 11/1965 | Kniffin et al. | 62/353 |
| 3,254,505 | 6/1966 | De Turk | 62/353 |
| 3,339,375 | 9/1967 | Fox | 62/353 X |
| 3,667,651 | 6/1972 | Shapiro | 318/282 X |

*Primary Examiner*—William E. Tapolcai

*Attorney, Agent, or Firm*—Wenderoth, Lind & Ponack

[57] ABSTRACT

In a refrigerator of the domestic type where the tray of an ice making apparatus is turned down to permit ice pieces to be discharged therefrom, the present apparatus takes advantage of the characteristic of a synchronous motor incorporated therein. Namely, the direction of rotation of the synchronous motor is adapted to be periodically changed and no electrical change-over switching means is included in the apparatus. In accordance with the periodic conversion of the direction of rotation of the motor, the tray is adapted to be turned down and up, alternately. Furthermore, according to the present invention, whenever the ice making tray has been turned down or up, a twisting actuation is applied to the tray, thereby to make the ice pieces separate from the wall of the tray.

2 Claims, 15 Drawing Figures

(T = to)

(T = t1)

(T=t2)

(T=t3)

(T=t4)

(T=t5)

ICE MAKING APPARATUS TO BE INCORPORATED IN REFRIGERATORS

This application is a continuation-in-part application of U.S. patent application Ser. No. 172,281 filed July 25, 1980, now abandoned.

BACKGROUND OF THE INVENTION

This invention relates to a small-sized domestic refrigerator, and more particularly, to an electric ice making apparatus capable of automatically discharging ice pieces from a freezing tray incorporated therein.

Up to the present, there have been proposed a number of ice making apparatuses of the above described type each provided with an arrangement capable of automatically discharging ice pieces from a freezer or ice making tray incorporated therein. According to one typical arrangement, the ice pieces are automatically discharged from the freezer tray by means of a specific cam, which is conventionally mounted on the shaft of a driving motor. The driving motor per se is adapted to be stopped in response to a signal indicative of a deviation with respect to a predetermined temperature inside the freezing compartment of the refrigerator. More specifically, there is further provided a crank-pin capable of being driven by the rotation of the cam, so that the freezer tray and the cam are functionally associated. As soon as the cam is set free from the engagement with the crank-pin, after being driven through a predetermined angular distance, the freezer tray, which has been biased by a spring means, is adapted to be set free and to collide with a stop. By the collision between the stop and the freezer tray, the respective ice pieces in the freezer tray are separated from the tray and fall from the freezer tray. Alternatively, according to another typical arrangement, the freezer tray itself is rotated in one direction around a longitudinal axis by a rotational driving force, and full rotation is arranged to be prevented by a stop, so that the further application of the driving force to the stopped freezer tray causes the freezer tray to be twisted relative to the stop. After the respective ice pieces are separated from the tray and fall from the freezer tray by the action described above, the freezer tray is adapted to be turned in the opposite direction by a driving motor actuated by a change-over switch of the self-control type, thereby to cause the freezer tray to be disposed in the initial position. These conventional arrangements, however, have such deficiencies as described hereinbelow. As far as the former arrangement is concerned, the violent collision described above is indispensable, and damage to or destruction of parts of the device such as the driving motor etc. are inevitable. In addition, there is the production of a noise with each collision. On the other hand, according to the latter arrangement, the change-over switch of the self-control type is indispensable to cause the driving motor to be rotated in one or the other direction properly. Such provision of the change-over switch makes the electrical circuit means more complicated than for the former arrangement, with the result that the cost for manufacturing the refrigerator is undesirably increased.

SUMMARY OF THE INVENTION

Accordingly, an essential object of the present invention is to provide an ice making apparatus to be incorporated in refrigerators, which can overcome all the disadvantages of the prior art specifically described in the foregoing.

Another important object of the present invention is to provide an ice making apparatus of the above described type, which has a specifically novel construction and, is highly efficient in use.

A further object of the present invention is to provide an ice making apparatus of the above described type, which is adaptable for any kind of refrigerator of the domestic type.

A still further object of the present invention is to provide an ice making apparatus of the above described type, which can be manufactured at low cost.

In accomplishing these and other objects according to one preferred embodiment of the present invention, there is provided an ice making apparatus to be incorporated in refrigerators, wherein a synchronous motor of the inductor type is employed as a driving means. Namely, the present apparatus takes advantage of the characteristic of the motor synchronizing with the alternating electric current supply in a manner such that the periodic conversion of the rotating direction of the motor can be effectively executed without any kind of specific switching means for this purpose. Consequently, by the arrangement as described above, in accordance with the periodic conversion of the rotating direction of the motor, the ice making tray is periodically turned down and up. In addition, according to the present invention, whenever the ice making tray is prevented from rotating freely either in a clockwise or in a counterclockwise direction after being rotated a predetermined angular distance, a twisting force is applied to the ice making tray. Accordingly, the ice pieces formed in the ice making tray gravitationally fall down into a receiving container disposed beneath the tray upon completion of the turning over.

More specifically, according to the present invention, the ice making apparatus comprises:

a synchronous motor of an inductor type, which is connected to an electrical circuit means including a heat-sensitive switching means, which is electrically connected in series to the synchronous motor so that the motor can be impressed with an electrical potential through said switching means, when a decrease in temperature in the vicinity of the ice making tray is detected;

a means including a driving gear mounted on the synchronous motor and a driven gear mounted on the shaft for rotating the ice making tray, which transmits a rotating force produced by the synchronous motor to the shaft for rotating the ice making tray;

a cam member mounted on the shaft for rotating the ice making tray;

a change-over lever pivotally coupled to a portion of the synchronous motor at the pivotal center thereof, the leading end of which is adapted to be located inside a plane corresponding to a cut off portion of the cam member, with an engaging pin being provided at the other end opposite to the leading end;

a pivotal movement regulating member oscillatorily connected to a portion of the synchronous motor by an axle, the outermost circumference of said pivotal movement regulating member being provided with a connecting member having an aperture so as to cause the engaging pin of the change-over lever to be connected through a pin and aperture engagement, while engageable shoulders are provided for one side surface of the pivotal movement regulating member;

a rotary member, which is mounted on the motor shaft of the synchronous motor, with the outer circumference with respect to the motor shaft being adapted to be selectively caught by one of the shoulders during either the clockwise or counterclockwise drives applied to the leading end of the change-over lever; and a stop for restricting a free rotation of the ice making tray, thereby causing the ice making tray to be twisted, when the ice making tray is in a substantially horizontal state and in a substantially turned-over state.

By the arrangement as described above, after the change-over lever has been frictionally driven through a predetermined angular distance, the outer circumference of the rotary member is caught by one of the shoulders formed on the pivotal movement regulating member. Accordingly, a counter-load is applied onto the motor shaft of the synchronous motor.

As is clear from the description in the foregoing, in accordance with the periodic conversion of the rotational direction of the synchronous motor, the ice making tray is adapted to be alternately turned down and up, and thus, the ice pieces formed in the ice making tray can be automatically obtained. Consequently, since no sudden forces are applied to the parts of the apparatus, there are no possibilities that the motor and the like will be damaged. Furthermore, since special switching means and/or circuit arrangements such as those which are required in the conventional arrangements to cause the motors to be rotated in opposite directions are unnecessary according to the present invention, the ice making apparatus has a simple construction and can be manufactured at low cost.

BRIEF DESCRIPTION OF THE DRAWINGS

These and other objects and features of the present invention will become apparent from the following description of a preferred embodiment thereof and with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
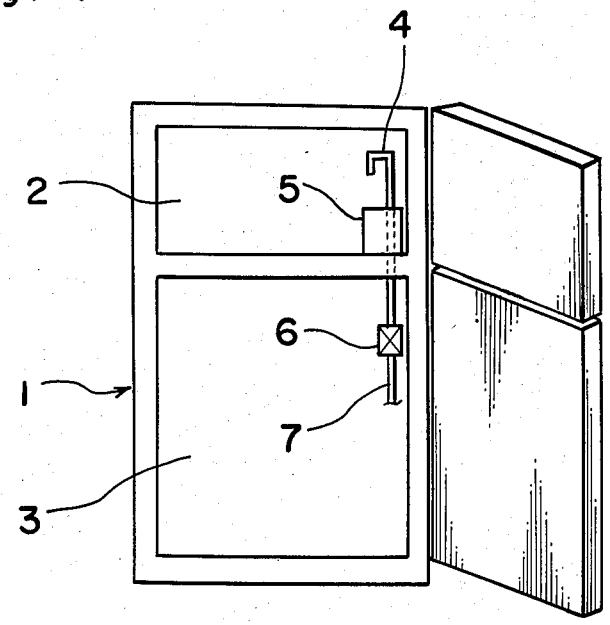
FIG. 1 is a front view of a refrigerator with front doors opened, particularly showing the incorporation of an ice making apparatus of the present invention.

Referring now to FIGS. 1 to 5, there is shown one preferred embodiment of the present invention, wherein an electric refrigerator 1 of the domestic type comprises a freezing compartment 2, a cold-storage compartment 3, an ice making apparatus 5 accommodated inside the freezing compartment 2, a water supply pipe 4 by which water is supplied to the ice making apparatus 5, a water feeding control valve 6 and an interconnecting pipe 7 connecting the water feeding control valve 6 with a water supply source provided outside the refrigerator.

Figure 2:
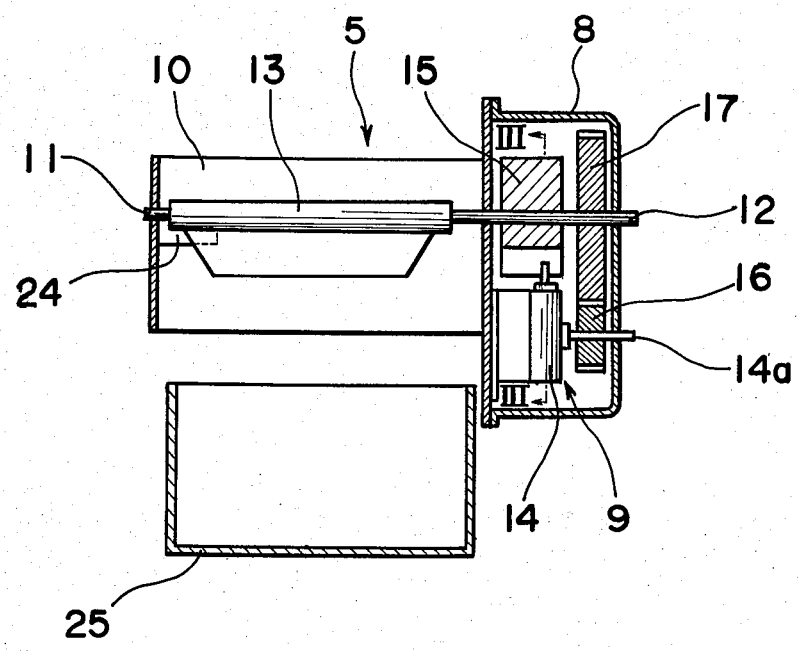
FIG. 2 is a partial, sectional view of one preferred embodiment of the ice making apparatus of the present invention.

As specifically shown in FIG. 2, the ice making apparatus 5 includes an electrical driving unit 9 in a first casing 8, and in a second casing 10, a compartmented ice making tray or a freezer tray 13, which is pivotally mounted inside the casing 10 on axles or shafts 11 and 12. The axle 12, however, extends inside the first casing 8 as will be described hereinbelow. The ice making tray 13 is made from a resilient material such as plastic or the like. Inside the casing 8, there are provided a synchronous motor 14 of the inductor type which is the driving unit of the apparatus 5 and which is a type in which the direction of rotation of the drive shaft is reversed when the rotation of the shaft is blocked, a cam member 15 mounted on the shaft 12 which supports the ice making tray 13 as described above, and a driving gear 16 meshed with a driven gear 17. More specifically, the driving gear 16 is fixedly mounted on a shaft 14*a* of the synchronous motor 14, and the outermost end of the shaft 14*a* is supported by the casing 8. The driven gear 17, which meshes with the driving gear 16, is mounted on the shaft 12, and the outermost end of the shaft 12 is also supported by the casing 8. In operation, in accordance with rotation of the synchronous motor 14, the driving gear 16 is rotated, and therefore, the driven gear 17 meshing with the gear 16 as described above is rotated. Since the ice making tray 13 is mounted on the same axle 12 with the driven gear 17, with the cam member 15 being, however, interposed between them, the ice making tray 13 is capable of being rotated in one or the other direction depending on the direction of rotation of the driven gear 17.

Hereinbelow, operations of the synchronous motor 14 of the above-described type will be described with reference to FIGS. 3, 4, and 5(*a*) to 5(*f*).

Firstly, the rotational direction of the synchronous motor 14 at the time of starting of the operation thereof will be described, hereinbelow.

Figure 3:
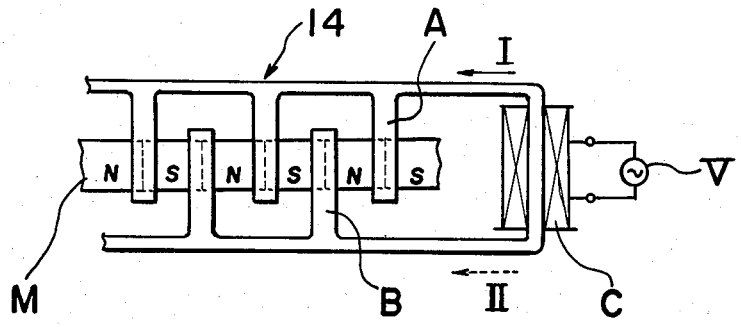
FIG. 3 is a development view of a synchronous motor of the inductor type employed in the ice making apparatus of FIG. 2.

Referring first to FIG. 3, there is shown the synchronous motor 14 including an AC power source V, an exciting coil C, magnetic pole teeth A and B, and a permanent magnet M as a rotor in which N and S poles are alternately magnetized in a circumferential direction of the outer cylindrical peripheral surface of the motor frame. When electric current is caused to start flowing in the exciting coil C in the synchronous motor 14, for example, of a single-phase inductor type which is excited by single-phase alternating current, the excitation produces alternating magnetic field, so that the rotational direction of the synchronous motor 14, i.e. the rotor depends on whether alternating voltage impressed at the time of starting of the operation of the synchronous motor 14 is positive or negative and thus, the rotational direction of the synchronous motor 14 at the time of starting of the operation thereof is not fixed.

Namely, in case a voltage is impressed so as to cause the magnetic flux to be directed in the direction indicated by the arrow I in FIG. 3, the magnetic pole teeth A and B are magnetized so as to be an N pole and an S pole, respectively, so that the rotor R is caused to start moving in the leftward direction in FIG. 3. Then, when the center of the S pole of the permanent magnet M has passed through the center of the magnetic pole tooth A and the center of the N pole of the permanent magnet M has passed through the magnetic pole tooth B, electric current in the exciting coil C is caused to flow in the reverse direction and thus, the magnetic flux is directed in the direction indicated by the arrow II in FIG. 3, so that the magnetic pole teeth A and B are magnetized so as to be the S and N poles, respectively, whereby the permanent magnet M as the rotor is caused to move further in the leftward direction in FIG. 3. Consequently, in accordance with the alternate periodic change in the direction of the magnetic flux into directions indicated by arrows I and II, with the alternate periodic change being synchronous with the frequency of the AC power source V, the permanent magnet M as the rotor is caused to continuously move in the leftward direction in FIG. 3.

On the other hand, in case a voltage is impressed so as to cause the magnetic flux to be directed in the direction indicated by the arrow II, the magnetic pole teeth A and B are magnetized so as to be an S pole and an N pole, respectively, so that the N and S poles of the permanent magnet M are attracted by the magnetic pole teeth A and B, respectively and thus, the permanent magnet M as the rotor is caused to start moving in the rightward direction in FIG. 3. Then, when the center of the N pole of the permanent magnet M has passed through the center of the magnetic pole tooth A and the center of the S pole of the permanent magnet M has passed through the center of the magnetic pole tooth B, electric current in the exciting coil C is caused to flow in the reverse direction and thus, the magnetic flux is directed in the direction indicated by the arrow I, so that the magnetic pole teeth A and B are magnetized so as to be the N and S poles, respectively, whereby the permanent magnet M as the rotor is caused to move further in the rightward direction in FIG. 3. Consequently, in accordance with the alternate periodic change in the direction of the magnetic flux into directions indicated by arrows II and I, with the alternate periodic change being synchronous with the frequency of the AC power source V, the permanent magnet M as the rotor is caused to move in the rightward direction in FIG. 3.

Thus, since the synchronous motor 14 is arranged to rotate in either a clockwise or a counterclockwise direction, depending on relative positions of the rotor and magnetic pole teeth A and B and on whether alternating voltage is positive or negative at the time of starting of the operation of the synchronous motor 14, the rotational direction of the synchronous motor 14 at the time of starting of the operation thereof is not fixed.

Secondly, the reversal of the direction of rotation of the motor shaft 14*a* when the rotation of the motor shaft 14*a* is blocked, will be described with reference to FIGS. 4 and 5(*a*) to 5(*d*), hereinbelow.

Figure 4:
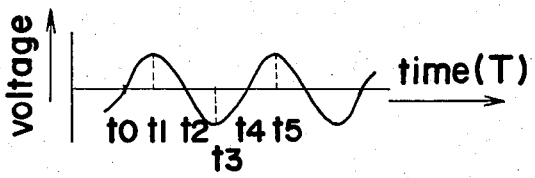
FIG. 4 is a wave form chart of a voltage applied to the synchronous motor of FIG. 3, FIGS. 5(*a*) to 5(*f*) are views similar to FIG. 3, each particularly showing relative positions of magnetic pole teeth and a permanent magnet as a rotor at a given time.

Referring to FIG. 4, there is shown a wave form chart of a voltage applied to the exciting coil C in which the voltage becomes null at the time of the $T=t_0$, $t_2$ and $t_4$ and reaches the peak at the time of $T=t_1$, $t_3$ and $t_5$. Meanwhile, the magnetic pole teeth A and B are disposed relative to the permanent magnet M as the rotor at $T=t_0$ as shown in FIG. 5(*a*). When the magnetic flux is directed in the direction indicated by the arrow at $T=t_1$ as shown in FIG. 5(*b*), the magnetic pole teeth A and B are magnetized so as to be the S and N poles, respectively and thus, the permanent magnet M is caused to move in the rightward direction in FIG. 5(*b*).

Figure 5:
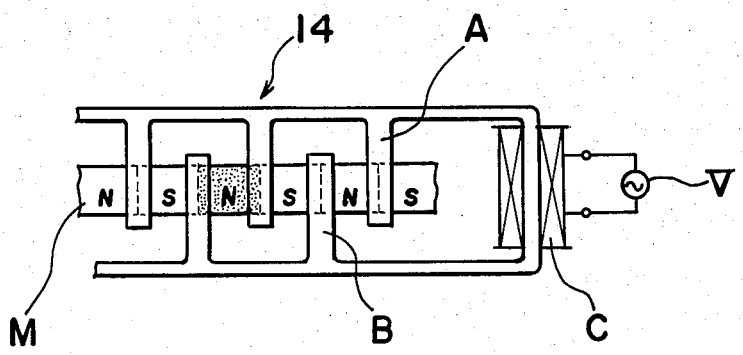
Figure 5:
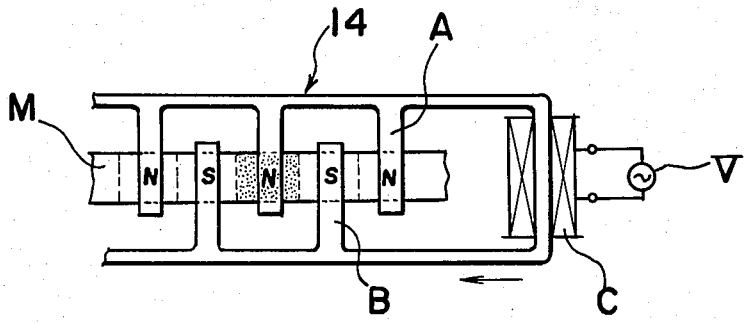
Figure 5C:
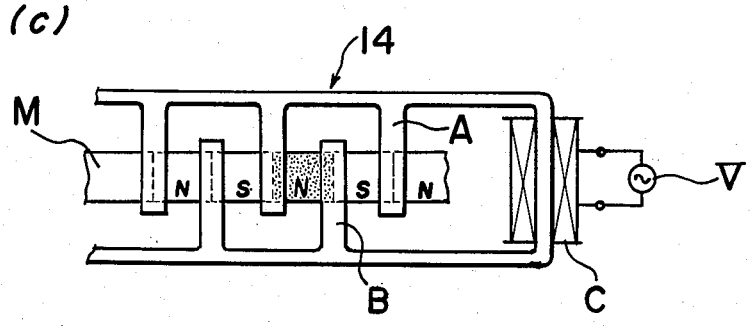
Figure 5D:
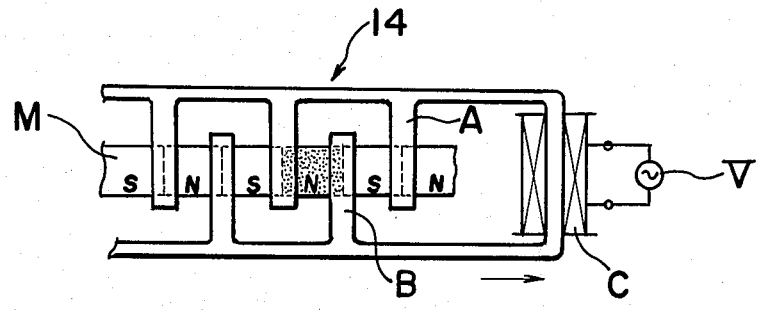
Figure 5E:
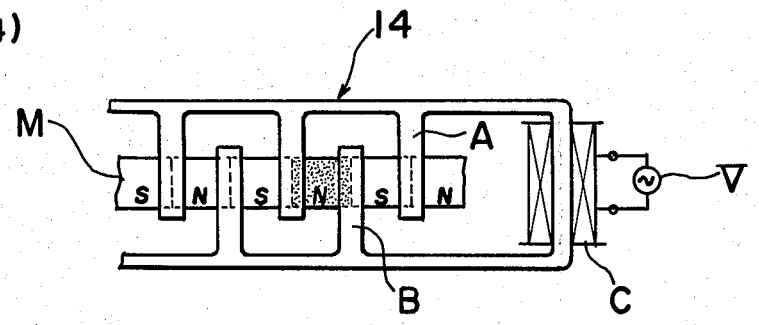
Figure 5F:
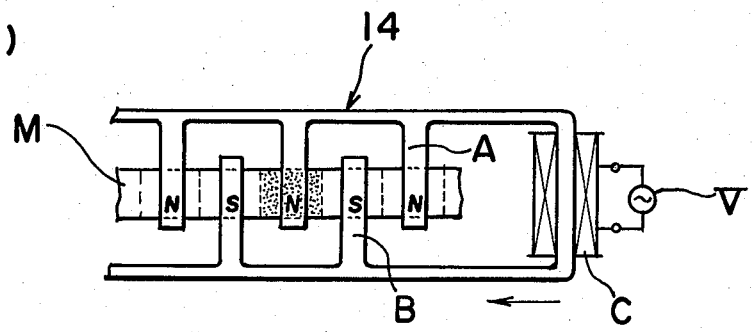

Then, the center of the N pole of the permanent magnet M passes through the center of the magnetic pole tooth A owing to the inertia of the permanent magnet M and then, the magnetic flux becomes null at $T=t_2$; namely the centers of the poles of the permanent magnet M are disposed at the center between the magnetic pole teeth A and B as shown in FIG. 5(*c*).

When an overload is applied to the motor shaft 14*a* so as to block the rotation of the motor shaft 14*a* at $T=t_2$, the permanent magnet M is brought to a stop because the overload is larger than a force for moving the permanent magnet M in the rightward direction.

At $T=t_3$ as shown in FIG. 5(*d*), the N pole of the permanent magnet M is attracted by the magnetic pole tooth B and the permanent magnet M is kept at a stop because the overload is larger than the force for moving the permanent magnet M in the rightward direction.

At $T=t_4$ as shown in FIG. 5(*e*), the permanent magnet M is still kept at a stop.

Since, at $T=t_5$ as shown in FIG. 5(*f*), the direction of the magnetic flux is the same as that at $T=t_1$, the permanent magnet M is brought back to the state shown in FIG. 5(*b*), so that the permanent magnet M is caused to move from the position shown in FIG. 5(*e*) to the position shown in FIG. 5(*f*) and thus, the permanent magnet M as the rotor starts moving in the leftward direction.

Thus, when an overload is applied to the motor shaft 14*a* so as to block the rotation thereof, the permanent magnet M as the rotor is caused to move in the reverse direction and thus, the direction of rotation of the motor shaft 14*a* is reversed.

Figure 6:
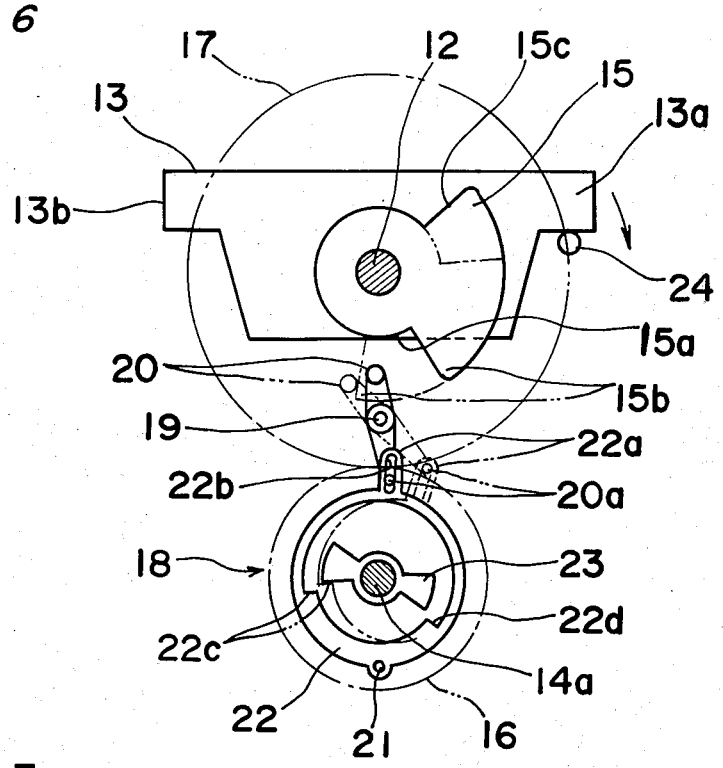
FIG. 6 is a sectional view taken along the line III—III of FIG. 2.

Referring now to FIG. 6, there is shown a rotational direction change-over mechanism 18 incorporated in the synchronous motor 14, so that the direction of rotation of the synchronous motor 14 can be reversed. The rotational direction change-over mechanism 18 of the present invention has a projectable lug on a change-over lever 20 at a leading end thereof which is located inside the periphery of the outer peripheral surface of a cam member 15, i.e. into the space left by a cut-off portion of the cam member 15, and the change-over lever 20 per se is pivotally mounted on a portion of the synchronous motor 14 on a pin 19. Furthermore, there is provided a pivotal movement regulating ring 22, which is oscillatorily mounted on a portion of the synchronous motor 14 on an axle 21. On the outermost circumference of the pivotal movement regulating ring 22, there is provided a connecting member 22*a* having an elongated aperture 22*b*. To connect the pivotal movement regulating ring 22 with the change-over lever 20, an engaging pin 20*a* is provided on the other end of the change-over lever 20 which is the opposite end from the one end having the lug as described above, and is accommodated in the aperture 22*b*. In addition, within the outer circumference of the pivotal movement regulating ring 22, there is further provided a rotatable or rotary member 23, which is fixedly mounted on the motor shaft 14*a* of the synchronous motor 14. By means of this rotatable member 23, the direction of rotation of the synchronous motor 14 is convertible in a manner as described hereinbelow. Namely, by a pivotal displacement of the change-over lever 20, which is caused by the engagement of the lug by either of the shoulder portions 15*b* and 15*c* of the cam member 15, the ring 22 is pivoted, for example to the phantom line position in FIG. 6, and rotation of the rotatable member 23 is restricted, since the outer circumference of the rotatable member 23 engages one or the other of engageable shoulders 22*c* and 22*d* on the pivotal movement regulating ring 22. Such being the case, when the free rotation of the rotatable member 23 is restricted in the manner as described above, the synchronous motor 14 is loaded, whereby the direction of rotation is reversed.

Still referring to FIG. 6, there is shown a stop 24, with which either of lid portions 13*a* and 13*b* of the ice making tray 13 is engaged. More specifically, when the lid portion 13*a* is engaged with the stop 24, the ice making tray 13 is held in a substantially horizontal position thereof with the open side up, i.e. in the up position as specifically shown in FIG. 6. On the other hand, when the lid portion 13*b* is engaged by the stop 24 as specifically shown in FIG. 7, the ice making tray 13 is turned upside down. Under both of these conditions, the tray 13 is being urged toward the stop 24 and is twisted with respect to the stop 24 as described hereinafter. Thereby, the ice pieces separated not only from each other, but also from the ice making tray 13 successively gravitationally fall down into a receiving container 25 (see FIG. 2).

Figure 8:
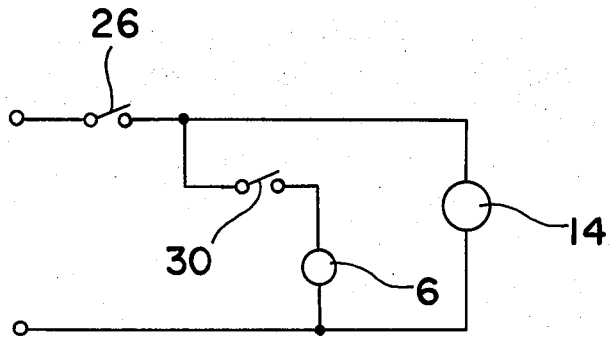
FIG. 8 is an electrical circuit diagram for the embodiment shown in FIG. 1 according to the present invention.

Referring now to FIG. 8, there is shown an electric circuit means including a heat-sensitive switching means 26. The heat-sensitive switching means 26 is actuated, in response to a change of temperature inside the freezing compartment 2 with respect to a predetermined specific temperature, and is electrically connected in series to the synchronous motor 14 as shown in FIG. 8.

The operation and effectiveness of the above described embodiment of the present invention are described hereinbelow.

Figure 7:
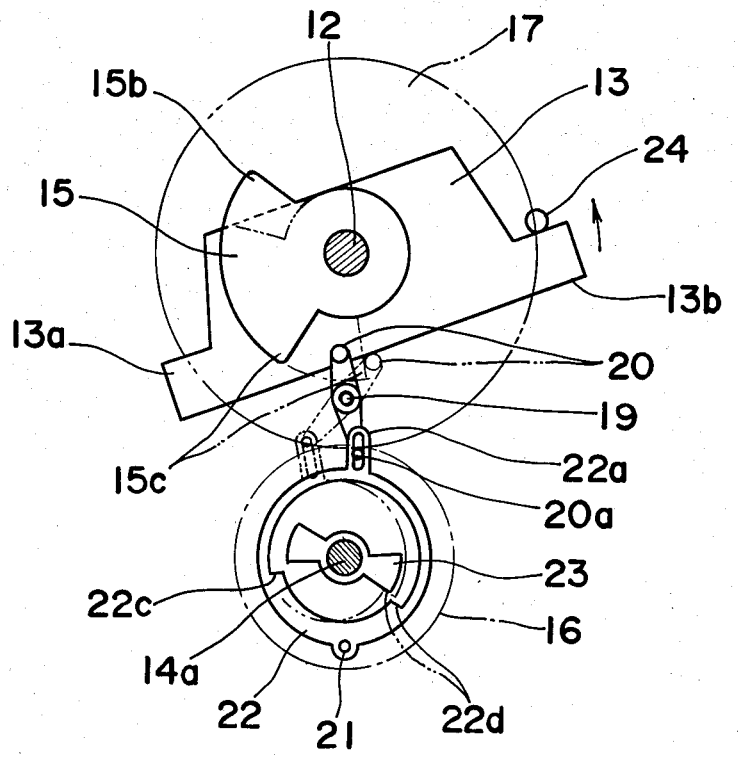
FIG. 7 is a view similar to FIG. 6, particularly showing the parts in positions where an ice making tray is being turned face down.

First of all, water having a specific temperature (e.g. 20° C.), which is supplied from the outside, is introduced into the ice making tray 13 while it is held in the up position as shown in FIG. 6. More specifically, the ice making tray 13 is being held in a substantially horizontal state thereof, with the lid portion 13*a* being urged toward the stop 24. The water supplied to the ice making tray 13 is frozen by heat exchange with the cold air inside the freezing compartment 2. Such being the case, when the decrease in temperature inside the freezing compartment 2 is detected by the heat-sensitive switching means 26 to have fallen below a predetermined temperature, the heat-sensitive switching means 26 is switched to an ON mode. Soon after the switching means 26 is actuated in the manner as described above, the synchronous motor 14 is supplied with the electrical potential and rotated, for example, counterclockwise in FIG. 3. Thus, with the rotation of the synchronous motor 14, the driving gear 16 on the same shaft with the synchronous motor 14 is also rotated counterclockwise, and the ice making tray 13 is rotated clockwise through a corresponding rotation of the driven gear 17. As described earlier, the driven gear 17 is meshed with the driving gear 16. In spite of clockwise rotating force applied to the ice making tray 13, the tray 13 is prevented from free, clockwise rotation by the stop 24 but is urged against the stop 24. The restriction of the rotation of the freezer tray 13 as described above causes the ice making tray 13 to be twisted in a direction illustrated by the arrow in FIG. 6. Thus, since the tray 13 is made from a resilient material, the whole of the tray 13 can be easily twisted and thus, ice pieces which are frozen inside each of the compartments formed in the tray 13 are correspondingly shifted not only relatively to the walls of the tray 13, but also relatively to each other. As is clear, this twisting actuation can also cause cracks to occur in the ice pieces in the tray 13 and, further makes it possible for them to be easily separated from the tray 13. In contrast, in the period of time during which the tray 13 is being twisted, the motor shaft 14*a* keeps rotating counterclockwise, since the rotation of the rotary member 23 fixedly mounted on the motor shaft 14*a* is not restricted by the pivotal movement regulating ring 22. By the free rotation of the motor shaft 14*a*, the cam member 15 is forcibly rotated clockwise until the shoulder portion 15*b* drives the free end of the change-over lever 20 leftward in FIG. 6, thereby causing the change-over lever 20 to be pivotally rotated counterclockwise with respect to the pin 19 to the location shown by the phantom lines in FIG. 6. The pivotal movement regulating ring 22, which is pivotally connected to the change-over lever 20, through the pin 20*a*, is also displaced with respect to an axle 21 to the position shown by the phantom lines. When the pivotal movement regulating ring 22 has been displaced as described above, the outer circumference of the rotary member 23 engages the shoulder portion 22*c*, and thus, the rotation of the rotary member 23 is blocked. As described earlier, the motor shaft 14*a* is thus loaded, whereby the rotational direction of the motor shaft 14*a* is changed over and the motor shaft 14*a* begins to rotate clockwise. As a result, the driving gear 16 begins to rotate clockwise, and the driven gear 17 begins to rotate counterclockwise. Both the cam member 15 and the ice making tray 13 then begin to rotate counterclockwise. By the counterclockwise rotation of the ice making tray 13, the ice making tray 13 is turned over to a down position, as shown in FIG. 7, and the lid portion 13*b* is urged toward the stop 24. Even after engagement of the stop 24 by the lid portion 13*b*, in the period of time during which the shoulder portion 15*c* drives the change-over lever 20, thereby to pivotally move it with respect to the pin 19 to the position indicated by the phantom lines in FIG. 7, the motor shaft 14*a* keeps rotating clockwise. Accordingly, as shown in FIG. 7, the ice making tray 13 is twisted with respect to the stop 24 in the direction shown by the arrow, which direction is opposite to that shown in FIG. 6. This twisting action causes the ice pieces to be separated from each other and from the wall of the ice making tray 13. The ice pieces successively gravitationally fall down into the receiving container 25, which is disposed under the tray 13 as shown in FIG. 2. Meanwhile, when the change-over lever 20 is pivoted clockwise with respect to the pin 19 by the shoulder portion 15*c*, the pivotal movement regulating ring 22 is pivoted around the axle 21 from the position illustrated by full lines to the position illustrated by the phantom lines in FIG. 7. Accordingly, the rotary member 23, which is fixedly mounted on the motor shaft 14*a* and is being rotated, changes its rotational direction to the counterclockwise direction. This is due to the fact that since the rotary member 23 is restricted in its rotation by its engagement with the shoulder portion 22*d* of the pivotal movement regulating ring 22 at its circumference, the motor shaft 14*a* is loaded and thus changes its rotational direction. Therefore, the driving gear 16 begins to rotate counterclockwise, and the driven gear 17 is simultaneously driven clockwise, so that the ice making tray 13 is returned to its initial, normal state. Soon after the ice making tray 13 is returned to its up position, the water feeding control valve 6 is energized through a switching means 30 (see FIG. 8), which is positioned to detect the return of the ice making tray 13 to its up position in a known manner. Thus, the water is again supplied to the ice making tray 13 through the water supply pipe 4. When the water is supplied to the tray 13, the temperature inside the freezing compartment 2 is raised due to the heat exchange effected between the water and the low-temperatured air inside the freezing compartment 2. The rise in temperature inside the freezing compartment 2 is soon detected by the heat-sensitive switching means 26, thus resulting in the switching means 26 being opened and the rotation of the synchronous motor 14 being stopped.

The above described operation of the ice making tray 13 is repeated. In short, the ice pieces can be obtained by the rotational movement of the ice making tray 13 by the reversal of the rotational direction of the motor shaft 14*a*. Moreover, according to the present invention, if a width of the cutout portion of the cam member 15 is proper, both the duration of the change-over of the motor shaft 14*a* and twisting angles of the ice making tray 13 with respect to the stopper 24 can be easily modified.

Figure 9:
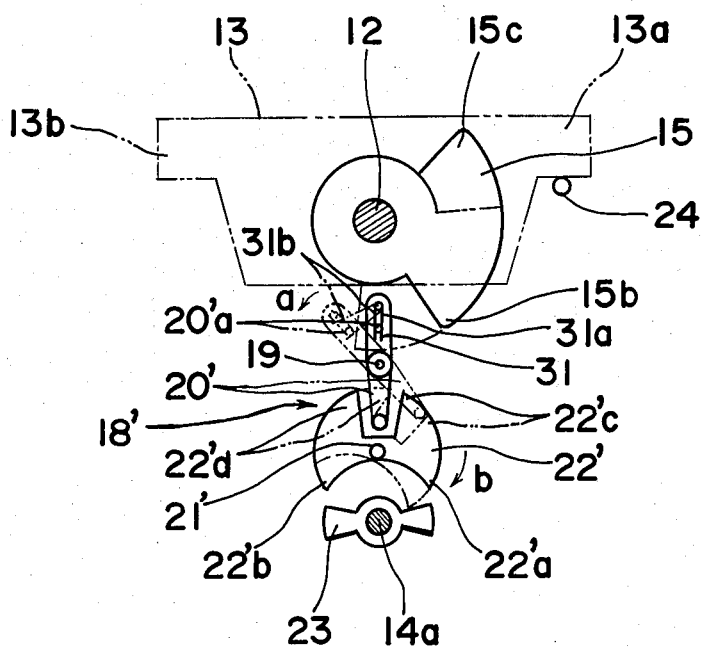
FIG. 9 is a view similar to FIG. 6, particularly showing a schematic, sectional view of a modified embodiment of the rotational direction change-over mechanism shown in FIG. 6 according to the present invention.

Referring now to FIG. 9, there is shown another embodiment of the present invention. This arrangement has the same constructions as described in the foregoing in the following points. First of all, the rotary member 23 is fixedly mounted on the motor shaft 14*a* of the synchronous motor 14. The cam member 15 is also mounted on the same shaft as that provided for the tray 13. There are provided the driving gear 16 mounted on the motor shaft 14*a* and the driven gear 17 mounted on the axle 12, which mesh each other, so that the driving force from the synchronous motor 14 is transmitted thereby. Furthermore, in addition to such similar elements as described above, there is also provided a change-over lever 20', which is capable of being changed over by the cam member 15, thereby to change over the rotational direction of the motor shaft 14*a*. However, in comparison with the former embodiment, there are some differences in respect to the construction of the rotational direction change-over mechanism 18' as follows. Namely, according to the present embodiment, there is provided a specific pivotal movement regulating plate 22', which is pivotally mounted on a shaft 21', and is disposed between the rotary member 23 and the change-over lever 20'. The shaft 21' per se is secured to the frame (not shown) of the motor 14. More specifically, according to the present invention, the pivotal movement regulating plate 22' includes a pair of engaging projections or shoulders 22'*a* and 22'*b*, each of which is adapted to be engaged by the rotary member 23, and a pair of engaging projections or shoulders 22'*c* and 22'*d*, each of which is adapted to be engaged by the change-over lever 20'. However, the projections 22'*a* and 22'*b* are provided on one side of the pivotal movement regulating plate 22', while the projections 22'*c* and 22'*d* are provided on the other side. In addition, according to the present invention, there is provided an approximately U-shaped spring member 31 having a pair of resilient leg portions 31*a* and 31*b*, a base portion of the spring member 31 being fixedly connected to a frame (not shown here) of the synchronous motor 14. By the arrangement described above, a pin 20'*a* on the change-over lever 20' is alternatively urged by the respective leg portions 31*a* and 31*b* as described hereinbelow.

In short, according to this modified embodiment, the rotational direction converting means 18' comprises the change-over lever 20' pivotally coupled to the portion of the synchronous motor 14 at the pivotal center thereof and provided with the pin 20'*a* at the upper portion thereof; the spring member 31, which is secured to the portion of the synchronous motor 14 at the base thereof and having two leg portions 31*a* and 31*b* each being capable of urging the pin 20'*a* when driven by the cam member 15; the rotary member 23, which is mounted on the motor shaft 14*a*; and the pivotal movement regulating plate 22', which is mounted on the shaft 21' secured to the portion of the synchronous motor 14 and disposed between the change-over lever 20' and the rotary member 23. The pivotal movement regulating plate 22' is provided with a pair of engaging shoulders 22'*c* and 22'*d* on one side thereof, thereby to make one of the shoulders 22'*c* and 22'*d* selectively engage the lower portion of the change-over lever 20', and with a pair of engaging shoulders 22'*b* and 22'*a* on the other side thereof, thereby to make one of the shoulders 22'*b* and 22'*a* selectively engage one side or the other of the rotary member 23 on the motor shaft 14*a*, when the lower portion of the change-over lever 20' is engaged with one of the engaging shoulders 22'*d* and 22'*c* due to the urging force applied to the pin 20'*a*.

The operation and effectiveness of the above described modified embodiment are described hereinbelow.

First of all, the heat-sensitive switching means 26 is actuated so as to be closed and thus, by the counterclockwise rotation of the synchronous motor 14, the driving gear 16 is driven counterclockwise, and the driven gear 17 is driven clockwise. However, upon initiation of rotation of the members constituting the arrangement, as can be seen in FIG. 9, the ice making tray 13 is prevented from free rotation, with the lid portion 13*a* being urged toward the stop 24. Such being the case, since the ice making tray 13 is twisted with respect to the pin 24, the ice pieces formed in the tray 13 are cracked and/or separated from the tray walls. Thus, these ice pieces become easily separable from the tray 13. In the period of the time during which the tray 13 is being twisted, the rotary member 23 keeps rotating counterclockwise in accordance with the rotation of the motor shaft 14*a*, since the respective engaging projections or shoulders 22'*a* and 22'*b* are positioned so as not to interfere with the rotation of the rotary member 23 as shown by the full lines in FIG. 9. Therefore, the cam member 15 is forcibly rotated clockwise, whereby the portion of the change-over lever 20', is driven by the engaging shoulder 15*b* in a direction illustrated by the arrow a in FIG. 9, and the change-over lever 20' is thus pivotally displaced with respect to the pin 19 to the position illustrated by the phantom lines. Accordingly, the pivotal movement regulating plate 22' is rotated with respect to the shaft 21' in the direction illustrated by the arrow b in FIG. 9. As a result, the rotary member 23 is restricted in its rotation by engagement with the engaging shoulder 22'a and the motor shaft 14a is loaded. After being loaded, the rotational direction of the motor shaft 14a is changed to the clockwise direction. In accordance with the clockwise rotation of the motor shaft 14a, the rotary member 23 is rotated clockwise, which causes the pivotal movement regulating plate 22' to be rotated with respect to the shaft 21 to the position illustrated by full lines in FIG. 9. As a result, the rotary member 23 is set free of the pivotal movement regulating plate 22' and, can rotate clockwise freely. When the driving gear 16 is rotated clockwise, the driven gear 17 is driven counterclockwise, and both the cam member 15 and the ice making tray 13 are simultaneously rotated counterclockwise. The ice making tray 13 is rotated until its lid portion 13b engages the stop 24, so that the ice making tray 13 is turned to the down position. However, even after the lid portion 13b is in engagement with the stop 24, in the period of the time which the change-over lever 20' is being pivotally displaced with respect to the pin 19 by the shoulder portion 15c, the motor shaft 14a keeps being rotated clockwise. As can be easily understood, such being the case, the ice making tray 13 can not help being urged in a reverse direction relative to the direction as described above, whereby the ice making tray 13 per se is as a whole twisted. During the twisting of the ice making tray 13, the ice pieces, each being frozen inside the respective compartments in the tray 13 are separated from the tray 13. Such ice pieces gravitationally fall down into the receiving container 25. Meanwhile, when the change-over lever 20' is pivotally displaced clockwise with respect to the pin 19 not only by the shoulder portion 15c, but also by a consequent urging force effected by the spring leg 31b, the pivotal movement regulating plate 22' is rotated counterclockwise with respect to the shaft 21' from the intermediate position thereof. Accordingly, the rotary member 23 engages the engaging shoulder 22'b of the pivotal movement regulating plate 22' and is restricted in its rotation. By this rotational restriction of the rotary member 23, the motor shaft 14a is loaded and then the rotational direction of the motor shaft 14a is changed to the counterclockwise direction. Then the driving gear 16 is driven counterclockwise, and the driven gear 17 is driven clockwise, and the ice making tray 13 is returned to its initial, up position. Successive operations of this embodiment are the same as those described in connection with the former embodiment.

Figure 10:
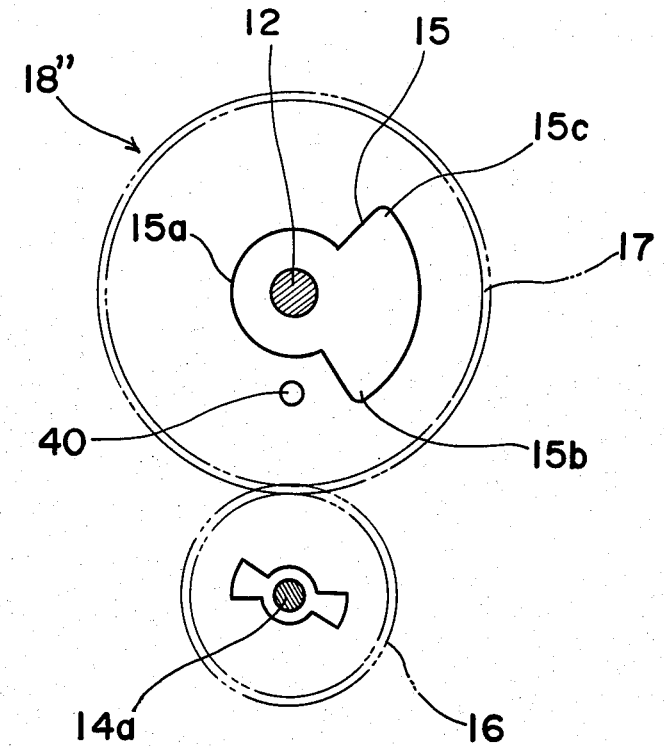
FIG. 10 is a view similar to FIG. 9, particularly showing a schematic sectional view of a further modified embodiment of the rotational direction change-over mechanism shown in FIG. 9 according to the present invention.

Referring now to FIG. 10, there is shown a further embodiment 18'' of the rotational direction change-over mechanism. According to this embodiment, the respective shoulders 15b and 15c are adapted to be alternately engaged with a stop 40 in a manner such that an action required for reversing the direction of rotation of the motor shaft 14a can be provided. The actuating torque for this purpose must, however, be more than the maximum torque of the motor shaft 14a in an ordinary rotating condition. By the arrangement described above, the rotational direction of the shaft 14a of the synchronous motor 14 can be reversed.

As is clear from the description in the foregoing, according to the present invention, by the periodic reversal of the direction of rotation of the synchronous motor, the ice making tray is adapted to be turned down and up, alternately, thereby to automatically obtain the ice pieces formed in the ice making tray. Consequently, since no sudden forces are applied to the parts such as the motor or the like, there is no possibility of damage to these parts. Furthermore, according to the present invention, there is no need to use a special switching means and/or a circuit arrangement such as those which are required in the conventional arrangements to cause the motor to be rotated one way and then the other way. Since such switching means and the like are omitted according to the present invention, the ice making apparatus of the present invention has a simple construction and can be manufactured at low cost. In addition, whenever the ice making tray is prevented from free rotation either in the clockwise direction or in the counterclockwise direction, the ice making tray is twisted according to the present invention. This twisting is quite useful for completely discharging the ice pieces from the ice making tray, since the ice pieces in the ice making tray are separated from the wall of the tray in the most advantageous way.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ice making apparatus to be incorporated in a refrigerator comprising:

an ice making tray;

a tray shaft on which said tray is mounted for being turned over from an up position to a down position so as to permit ice pieces to be discharged therefrom;

an inductor type synchronous motor of the type in which the motor is reversed when the drive shaft thereof is blocked;

a driving gear mounted on said drive shaft of said synchronous motor;

a driven gear mounted on said tray shaft and meshed with said driving gear for rotating said ice making tray;

a cam member mounted on said tray shaft;

a changeover lever pivotally mounted on said synchronous motor at the center of said lever, one end of said lever being movable into the path of said cam member for being pivoted in one or the other directions by said cam as said tray shaft rotates to one or the other of two predetermined positions with said tray in the up and down positions, and an engaging pin on the other end of said lever;

a pivotal movement regulating member oscillatorily mounted on a portion of said synchronous motor, said pivotal movement regulating member having a connecting member having an aperture on an outermost circumference thereof in which said engaging pin is slidable for causing said pivotal, engageable movement regulating member to move to one or another of two oscillatory positions when said changeover lever is pivoted in one or the other directions by said cam, said pivotal movement regulating member further having shoulders thereon;

a rotary member mounted on said drive shaft of said synchronous motor, one shoulder being moved into the path of said rotary member to block rotation thereof when said pivotal movement regulating member is in one of said oscillatory positions and the other shoulder being moved into the path of said rotary member to block rotation thereof when said pivotal movement regulating member is in the other oscillatory position; and a stop for restricting free rotation of said ice making tray at a point ahead of said predetermined positions for causing said ice making tray to be twisted when said ice making tray is in the up position and in the down position.

2. An ice making apparatus to be incorporated in a refrigerator comprising:

an ice making tray;

a tray shaft on which said tray is mounted for being turned over from an up position to a down position so as to permit ice pieces to be discharged therefrom;

an inductor type synchronous motor of the type in which the motor is reversed when the drive shaft thereof is blocked;

a driving gear mounted on said drive shaft of said synchronous motor;

a driven gear mounted on said tray shaft and meshed with said driving gear for rotating said ice making tray;

a cam member mounted on said tray shaft;

a changeover lever pivotally mounted on said synchronous motor at the center of said lever and having a pin member at the upper end thereof projecting into the path of rotation of said cam member for being pivoted in one or the other directions by said cam as said tray shaft rotates to one or the other of two predetermined positions with said tray in the up and down positions;

a spring member secured to said synchronous motor at a base portion thereof and having two leg portions engageable with said pin member for urging said pin member to one of two spaced positions when said pin is engaged by said cam member;

a rotary member mounted on said drive shaft of said synchronous motor;

a pivotal movement regulating member pivotally mounted on said synchronous motor and being positioned between said changeover lever and said rotary member, said pivotal movement regulating member having a pair of first and second engaging shoulders on one side thereof engageable by the lower end of said changeover lever, and a pair of third and fourth engaging shoulders on the other side thereof, one of said third and fourth shoulders being engaged by said rotary member on said drive shaft to block rotation thereof when said pin is urged to one position, and the other of said third and fourth shoulders being engaged by said rotary member on said drive shaft to block rotation thereof when said pin is urged to the other position; and a stop for restricting free rotation of said ice making tray at a point ahead of said predetermined positions for causing said ice making tray to be twisted when said ice making tray is in the up position and in the down position.

* * * * *